US005812096A

United States Patent [19]

Tilford

[11] Patent Number: 5,812,096

[45] Date of Patent: Sep. 22, 1998

[54] MULTIPLE-SATELLITE RECEIVE ANTENNA WITH SIAMESE FEEDHORN

[75] Inventor: Arthur R. Tilford, Yorba Linda, Calif.

[73] Assignee: Hughes Electronics Corporation, El Segundo, Calif.

[21] Appl. No.: 939,051

[22] Filed: Sep. 26, 1997

Related U.S. Application Data

[63] Continuation of Ser. No. 544,423, Oct. 10, 1995, abandoned.

[51] Int. Cl.[6] ..... H01Q 13/00

[52] U.S. Cl. ..... 343/781 R; 343/776; 343/786; 343/840

[58] Field of Search ..... 343/781 R, 781 P, 343/776, 839, 840, 756, 786, 909, 910, 772, 911 R

[56] References Cited

U.S. PATENT DOCUMENTS

| | | | |
|---|---|---|---|
| 3,495,262 | 2/1970 | Paine | 343/776 |
| 3,633,208 | 1/1972 | Ajioka | 343/786 |
| 4,618,866 | 10/1986 | Makino et al. | 343/781 P |
| 4,757,324 | 7/1988 | Dhanjah | 343/786 |
| 4,758,842 | 7/1988 | Linhardt et al. | 343/786 |
| 4,777,491 | 10/1988 | Bassi et al. | 343/781 P |
| 4,785,306 | 11/1988 | Adams | 343/786 |
| 5,258,768 | 11/1993 | Smith | 343/786 |
| 5,461,394 | 10/1995 | Weber | 343/776 |
| 5,517,203 | 5/1996 | Fiedziuszko | 343/786 |

*Primary Examiner*—Hoanganh T. Le
*Assistant Examiner*—Tan Ho
*Attorney, Agent, or Firm*—Michael W. Sales; John A. Crook

[57] ABSTRACT

A siamese feedhorn for a satellite receiving antenna capable of simultaneously receiving signals from satellites in different geostationary satellite positions. The siamese feedhorn preferably includes a first waveguide section mated with a second waveguide section. The first waveguide section is preferably positioned at the antenna's focal point to receive signals from within the antenna's beamwidth. The second waveguide section is positioned at an offset distance from the focal point to receive signals from a satellite in a different geostationary position.

68 Claims, 7 Drawing Sheets

MULTIPLE-SATELLITE RECEIVE ANTENNA WITH SIAMESE FEEDHORN

This is a continuation of application Ser. No. 08/544,423 filed Oct. 10, 1995 now abandoned.

BACKGROUND OF THE INVENTION

1. Field of the Invention

The present invention relates in general to satellite receive earth station s. More particularly, it relates to a feedhorn and antenna structure capable of simultaneously receiving signals from satellites in different geostationary positions.

2. Technical Field

Satellite-based communication systems typically beam signals from a terrestrial antenna to a geostationary satellite. The satellite processes and "downlinks" the signals to terrestrial satellite receive antennas located within the satellite's coverage area or footprint. On-board transponders modulate signals to an assigned carrier frequency and polarity, then send the signals to an on-board antenna for downlinking.

A typical satellite receive antenna uses a parabolic reflector dish to reflect and concentrate signals to a focal point. A feedhorn or waveguide is positioned at the focal point to receive the focused signals. The feedhorn directs the concentrated signals to a probe which responds to the focused signals by producing a small electrical signal.

The satellite receive antenna must generally be aimed or boresighted at the desired satellite. An antenna's beamwidth generally relates to the geostationary positions from which the antenna can receive signals. For example, a 5.5 meter antenna with a 0.32° beamwidth aimed at 99.0° W longitude sees geostationary satellites within 0.16° (0.32°/2) of arc to either side of 99.0° W longitude.

High-power satellites and powerful forward error-correction techniques have allowed direct broadcast satellite (DBS) transmissions to be received by very small aperture antennas, 24-inches in diameter or less. With the decreasing size and cost of very small aperture antennas, and the increasing demand for satellite services, a wide variety of new satellite services will soon be available to the home. Satellites in the western hemisphere, however, are generally spaced 2.0° to 3.0° of arc apart at geostationary positions ranging from 46.0° W longitude to 180.0° W longitude.

Because of the spacing between geostationary satellite positions and the directional nature of satellite receive antennas, a household wishing to subscribe to more than one satellite service must install a separate antenna for each satellite service. A household subscribing to several satellite services may require an array of satellite receive antennas. In addition to the cost of the extra equipment, the homeowner must find locations to install the antennas. Accordingly, there is a need for a very small aperture antenna which can simultaneously receive signals from satellites in different geostationary positions.

Very small aperture antennas, however, have not been used to receive signals from satellites in different geostationary positions. An antenna's beamwidth depends on its aperture size (diameter) and the frequency of the received signals. Very small aperture antennas have a wider beamwidths than large aperture antennas. A very small 24-inch aperture antenna, has a wide beamwidth of 2.8° at the Ku-band frequencies (generally 9 GHz to 15 GHz). A 24-inch antenna boresighted at 99.0° W longitude sees satellites within 1.4° (2.8°/2) of arc to either side of 99.0° W longitude.

Because very small aperture antennas see a greater portion of the geostationary arc, a greater number of signals are crowded into a small focal area. Interference between satellites at adjacent geostationary positions is therefore a problem with very small antennas. Very small aperture antennas also have lower gain because they have less surface area in which to capture satellite signals. As a result of these physical constraints, very small antennas capable of simultaneously receiving signals from satellites in different geostationary positions have not been constructed.

Current approaches used for enabling a single antenna to receive signals from satellites in different geostationary orbits are not well suited for very small antennas. For example, motorized antennas with pivoting mounts have been used for non-simultaneous reception of different satellites. The motorized-mount allows the user to steer and aim the antenna at the desired satellite. Motorized antennas are thus able to receive signals from satellites in different geostationary positions. Motorized antennas, however, are more costly and complex than ordinary fixed satellite mounts. Also, frequently re-aiming the antenna is a tiresome and time-consuming procedure.

Moreover, receiving circularly polarized DBS signals requires a different feedhorn and low noise block (LNB) than those ordinarily used for receiving satellite signals. Traditional satellite services broadcast at the C-band (generally 3 GHz to 5 GHz) and the Ku-band frequencies using linearly polarized signals. DBS systems transmit at the higher Ku2-band (over 12 GHz) using high power circularly polarized signals. Because an antenna feedhorn ordinarily receives either linearly polarized signals or circularly polarized signals, but not both, the feedhorn must be modified to receive signals of the other polarization.

Existing large aperture fixed antennas are capable of simultaneously receiving broadcasts from satellites at different geostationary positions. Multiple-focus antennas typically use a large reflector which is parabolic in the vertical direction and spherical in a horizontal direction. The spherical shape of the reflector spreads the focal point of the antenna in a horizontal direction. Separate feedhorns are configured along the spread focal point to receive signals from satellites in different geostationary positions.

Existing multiple-focus antennas have several disadvantages. A specially designed and manufactured reflector is required to focus signals to different focal points. A multiple-focus antenna is therefore more complicated and difficult to manufacture and install. Multiple-focus antennas are also more susceptible to noise than conventional antennas and therefore require the use of more costly LNBs, typically the most expensive part of the satellite antenna. The gain of a multiple-focus antenna is also lower than conventional antennas because the focal point is spread horizontally. In addition, the multiple feedhorns block the antenna aperture, further reducing the antenna's efficiency. Multiple-focus antennas are therefore larger to compensate for their lower efficiency. The larger size of these antennas make them more costly and less practical for domestic use. Moreover, because multiple-focus antennas are of lower efficiency, very small aperture multiple-focus antennas have not been built.

Accordingly, there is a need for a single very small aperture antenna that can receive broadcasts from satellites in different geostationary positions.

SUMMARY OF THE INVENTION

The invention relates to a satellite receive antenna capable of simultaneously receiving signals from satellites at different geostationary positions. The invention includes a single feedhorn having a siamese construction. Preferably, the siamese construction includes at least two waveguide sections, each designed to receive a particular type of signal. For example, the first waveguide section may be constructed to receive linearly polarized Ku-band or C-band signals, and the second waveguide section may be constructed to receive circularly polarized Ku2-band signals. The two waveguide sections are aligned side-by-side and mated to form the siamese feedhorn.

The siamese feedhorn is preferably positioned such that a first waveguide section has its boresight at the focal point of the satellite receive antenna. The second waveguide section is positioned so that its boresight is at an offset from the focal point. At the offset location, the signals of a satellite outside the antenna's beamwidth show a defocused illumination pattern. The second waveguide has its boresight positioned at the offset location to receive signals from the defocused illumination pattern. Preferably, the offset distance is 1.5 to 2.5 cm from the focal point of the antenna.

The Siamese feedhorn allows a very small satellite receive antenna to simultaneously receive signals from satellites in close geostationary positions, less than 2.0° of arc apart. If the subject satellites downlink at different power levels, the satellite receive antenna is aimed or boresighted at the lower-power satellite. The first waveguide section thus receives signals from the boresighted satellite of lower-power at the focal point of the antenna. The second waveguide section receives the higher-power satellite signals at the offset location. When receiving signals from satellites with equal power levels, the antenna is boresighted between the two satellites. In this situation, the siamese feedhorn's waveguide sections are positioned at offset positions to either side of the focal point.

Another embodiment of the present invention provides a siamese feedhorn on a large aperture satellite receive antenna, thereby allowing the antenna to receive signals from satellites in very close geostationary positions, less than 1° of arc apart. For example, a large aperture antenna with a siamese feed can be used to receive signals from the DBS-1 and DBS-2 satellites outside their coverage area. The siamese feed allows the large antenna to be boresighted at one satellite while receiving signals from a second satellite outside its beamwidth. Preferably, both waveguide sections are constructed to receive circularly polarized signals.

Still another embodiment of the present invention is satellite receive antenna that receives different frequency signals from collocated satellites, as well as a satellite in a different geostationary position. The siamese feedhorn is positioned within the center of a larger C-band feedhorn which, in turn, is concentrically positioned within an even larger L-band feedhorn. The first waveguide section of the siamese feedhorn is preferably boresighted with the concentric C-band and L-band feedhorns. The concentric feedhorns enable reception of satellites broadcasting at different C-band, L-band, and Ku-band frequencies collocated at the same geostationary position. The second waveguide of the siamese feedhorn allows the simultaneous reception of signals from another satellite in a different geostationary position.

The satellite receive antenna of the present invention does not require the antenna to be re-aimed to receive signals from different satellites in different geostationary positions. Preferably, once the antenna is aimed at the desired satellite, the antenna need not be re-adjusted to receive broadcasts from a second satellite. A modified reflector design is not required, and the need for a redundant satellite antenna is eliminated. The present invention therefore reduces the cost of receiving multiple satellite signals.

The invention, together with further objects and attendant advantages, will best be understood by reference to the following detailed description, taken in conjunction with the accompanying drawings.

DETAILED DESCRIPTION OF THE PREFERRED EMBODIMENTS

Figure 1:
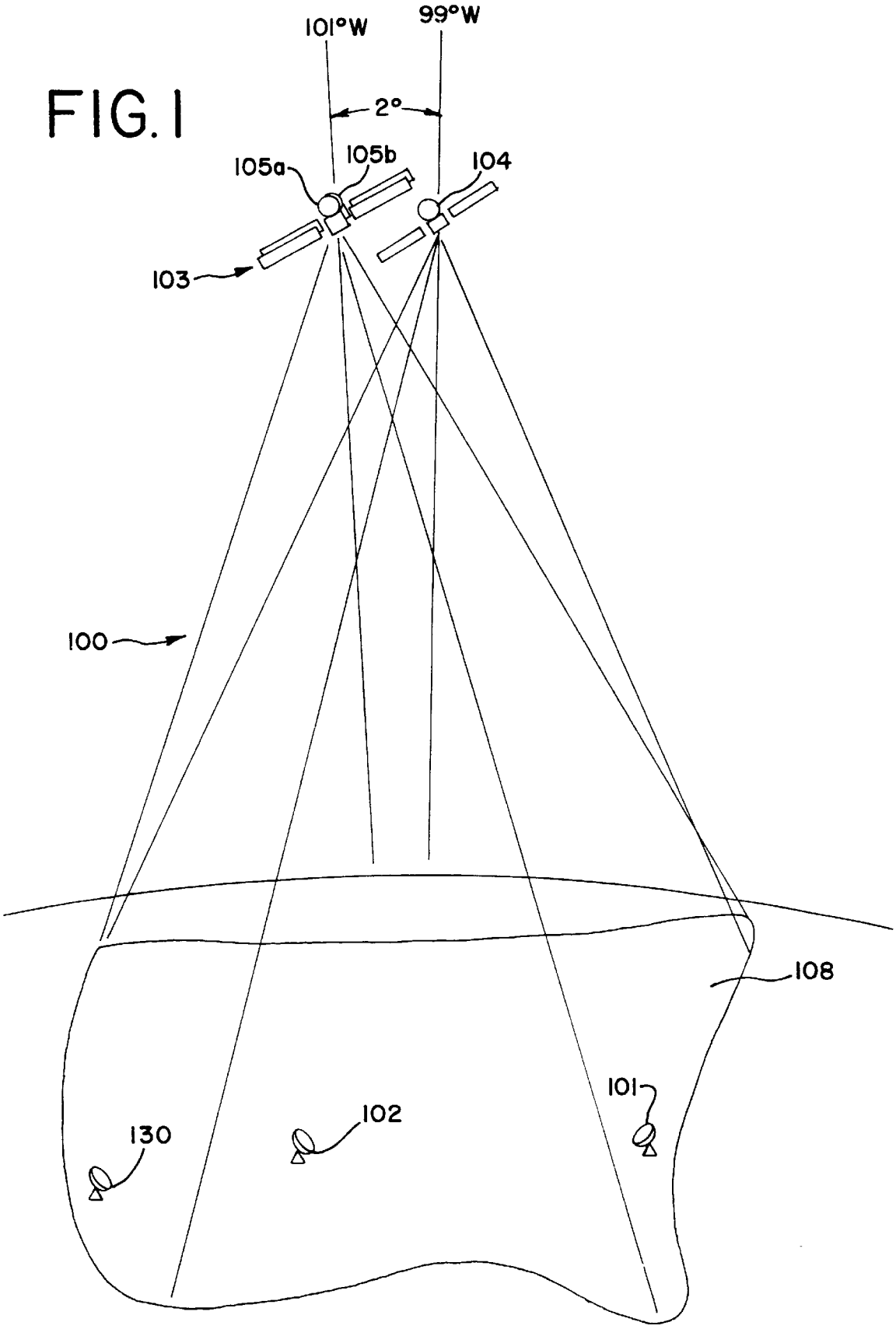
FIG. 1 illustrates a satellite system capable of using the present invention.

FIG. 1 illustrates a satellite system 100 capable of utilizing the present invention. The system 100 includes ground-based uplink transmitters 101, 102, a ground-based satellite receiver 130, and a space segment 103 consisting of orbiting satellites 104, 105*a*, 105*b*. In a typical application, the satellites 104, 105*a*, 105*b* are positioned at geostationary positions spaced approximately 2° of arc apart. For example, satellite 104 may be the Galaxy 4 satellite at 99.0° W longitude, and satellites 105*a*, 105*b* may be satellites DBS-1 and DBS-2, located at 101.2° W longitude and 100.8° W longitude.

Preferably, uplink transmitter 102 modulates a digital signal onto the assigned frequency carriers for uplink to satellites 105*a*, 105*b*. Satellites 105*a*, 105*b* translate the uplink carriers to the assigned Ku2-band downlink frequency carriers, (over 12 GHz), for downlink to the satellite receiver 130. The satellite 104 ordinarily transmits carrier signals with alternating left-hand circularly polarized (LHCP) and right-hand circularly polarized (RHCP) signals. Preferably, satellites 105*a*, 105*b* are high-power satellites that transmit downlink signals in a focused beam pattern 108. Similarly, the uplink transmitter 101 uplinks signals to satellite 104. The satellite 104 translates the carrier signals to the assigned C-band or Ku-band downlink frequencies for subsequent demodulation and downlink to the satellite receiver 130. The satellite 104 ordinarily transmits carriers with alternating vertical and linear polarity.

Figure 2:
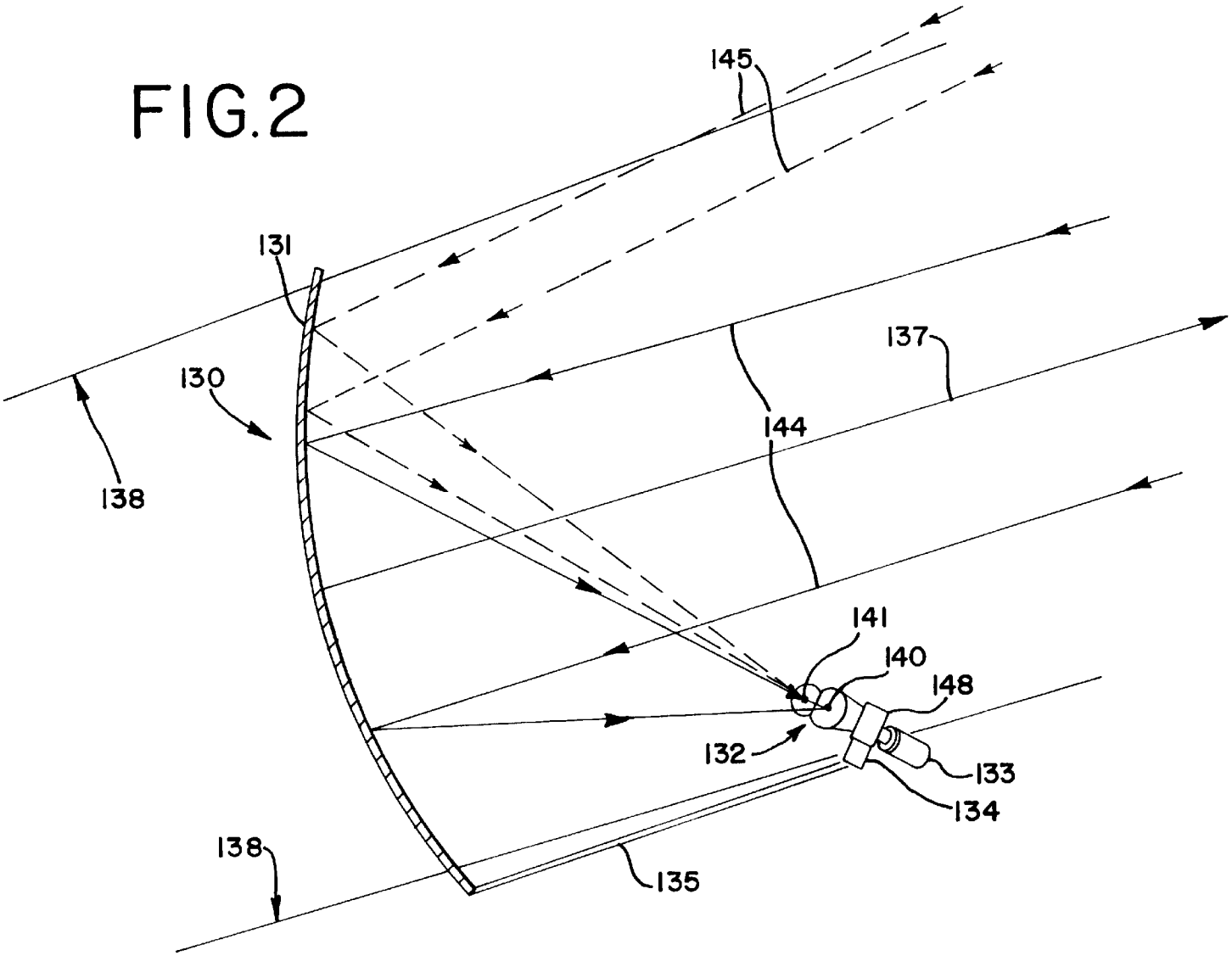
FIG. 2 is a diagram of a satellite receive antenna of the present invention.

Referring to FIG. 2, a preferred embodiment of the satellite receiver 130 has a small aperture antenna 131, a siamese feedhorn 132, two low noise blocks (LNB) 133, 134, and a feedhorn support arm 135. The antenna 131 has a boresight line 137, from which the antenna 131 receives signals with maximum gain, and a beamwidth 138 along the boresight. Signals 144 within the beamwidth 138 are reflected and focused by the antenna 131 to a focal point 140. Siamese feedhorn 132 and LNBs 133, 134 are mounted on a feedhorn support arm 135 and positioned at the focal point 140.

The antenna 131 may be a 24-inch parabolic offset antenna, available from manufacturers such as Lenson-Heath. Such an antenna is ordinarily made of metal or metal encased in fiberglass, or plastic. Prime focus antennas, well known in the art, are also suitable, but somewhat less preferred because of increased blockage by the feedhorn, LNB and support arm elements.

It should be understood that antennas of other aperture sizes may be used depending on signal frequency, signal power, satellite position, and the desired antenna gain. In addition, flat antennas, such as lens type antennas (e.g., a Fresnel lens), may also be used.

When satellite services are desired from two satellites broadcasting at different power levels, the antenna 131 is most preferably aimed or boresighted at the satellite with the lower-power signal. For example, to receive signals from the satellite 104 at 99.0° W longitude and the higher-power satellites 105*a*, 105*b* at 100.8° W longitude and 101.2° W longitude, the antenna 131 is boresighted at the lower-power satellite 104 at 99.0° W longitude.

Figure 3:
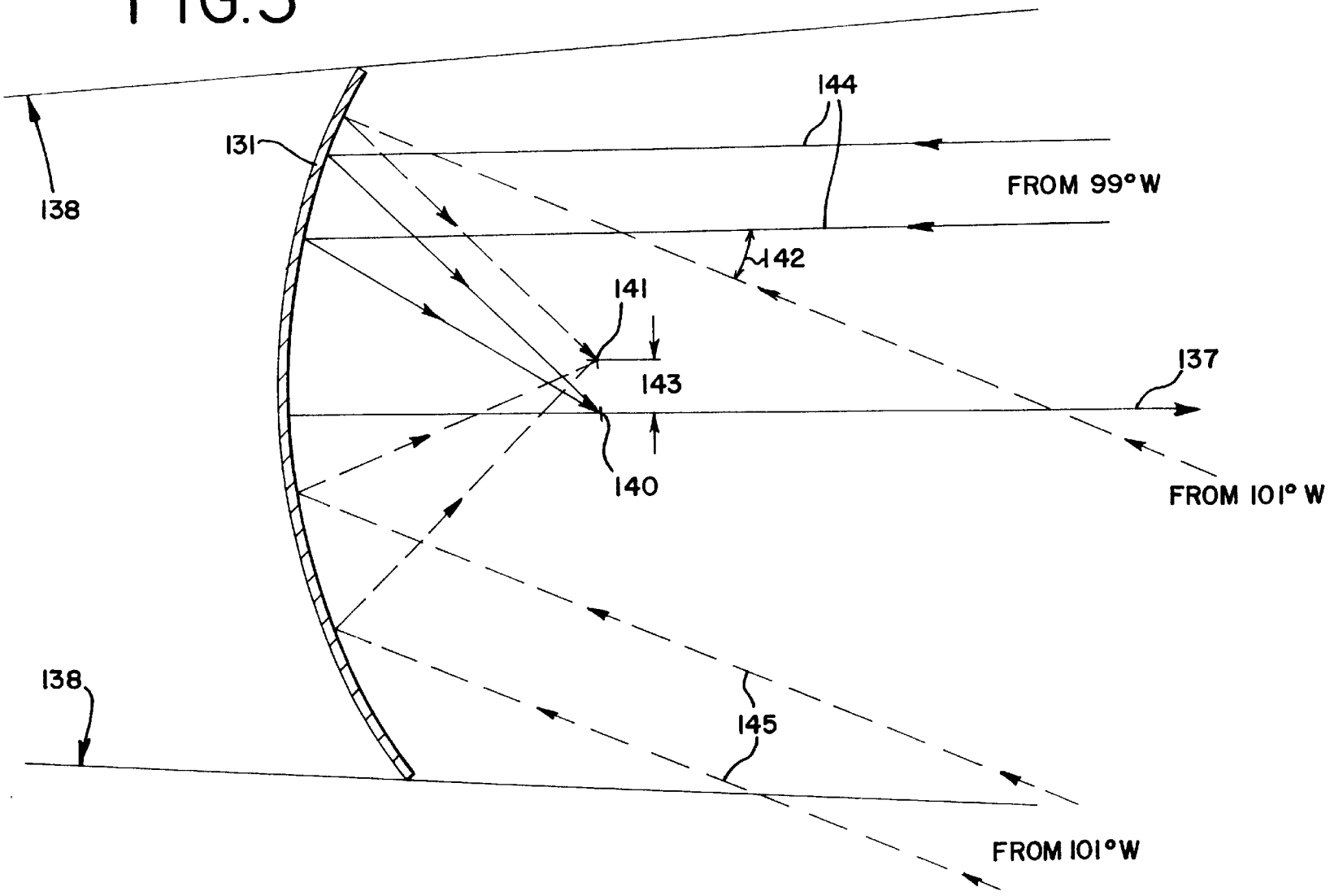
FIG. 3 is a top view diagram showing the satellite receive antenna shown in FIG. 2.

FIG. 3 is a top view diagram of the antenna 131 illustrating a typical focal point and offset region. The antenna 131 focuses satellite signals 144 from within its beamwidth 138 to a focal point 140. The antenna 131 has a beamwidth 138 of approximately 2.8° at the Ku-band. With the boresight 137 of the antenna 131 aimed at the 99.0° W location, the focal point 140 receives signals from 1.4° (2.8°/2) to either side of 99.0° W longitude, i.e., from 97.6° W to 100.4° W longitude. Signals 145 from the satellites 105*a*, 105*b* at approximately the 101° W longitude position are therefore not of sufficient strength to be seen by the focal point 140.

Signals 145 from a satellite outside the antenna beamwidth 138 are generally reflected by the antenna 131 to an offset region, and more particularly to an offset location 141. The offset location 141 may be chosen according to the separation between the satellites and the terrestrial antenna. Satellites 104 and 105*a*, 105*b* have different azimuth and elevation separation angles according to the terrestrial location of the antenna observing the satellites.

For all geographic locations in the continental United States, the difference in the observed azimuth angle 142 between the 99.0° W longitude satellite 104 and the 101° W longitude satellites 105*a*, 105*b* ranges from a minimum of 2.82° to a maximum of 4.60°. For example, from Los Angeles, Calif., the satellites 105*a*, 105*b* appear about 2.65° apart from the satellite 104. From Laredo, Tex., the satellites 105*a*, 105*b* appear to be about 4.14° apart from the satellite 104. Because the difference in azimuth angles between the satellite 104 and the satellites 105*a*, 105*b* varies from Los Angeles to Laredo, the offset location 141 varies. However, a single azimuth angle difference 142 can be used by choosing a fixed distance 143 between focal point 140 and offset location 141, resulting in an azimuth angle 142 approximately halfway between the range of the possible azimuth angles.

Preferably, the offset location 141 is a distance 143 between 1.5 to 2.5 cm from the focal point 140. Providing an offset location 141 at a fixed 1.5 to 2.5 cm distance from the focal point 140 results in an azimuth angle 142 suitable for simultaneously receiving both the 99.0° W satellite 104 and the 101.0° W satellites 105*a*, 105*b* from most terrestrial locations throughout the continental United States. One skilled in the art can readily calculate the range of azimuth angle differences 142 and corresponding offset distances for other geostationary satellite positions and terrestrial locations. A suitable fixed offset distance 143 can thus be selected from the calculated range.

Figure 4A:
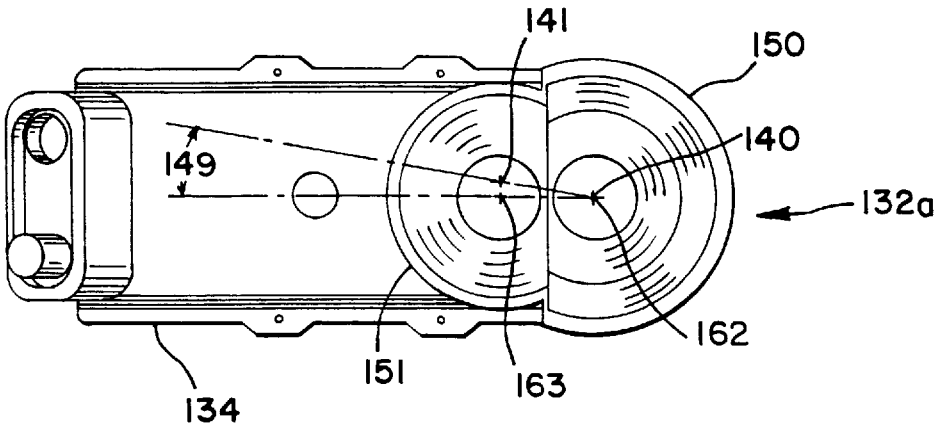
FIGS. 4*a*, 4*b*, and 4*c* are axial and two side views, respectively, of the siamese feedhorn of the satellite receive antenna shown in FIG. 2.
Figure 4B:
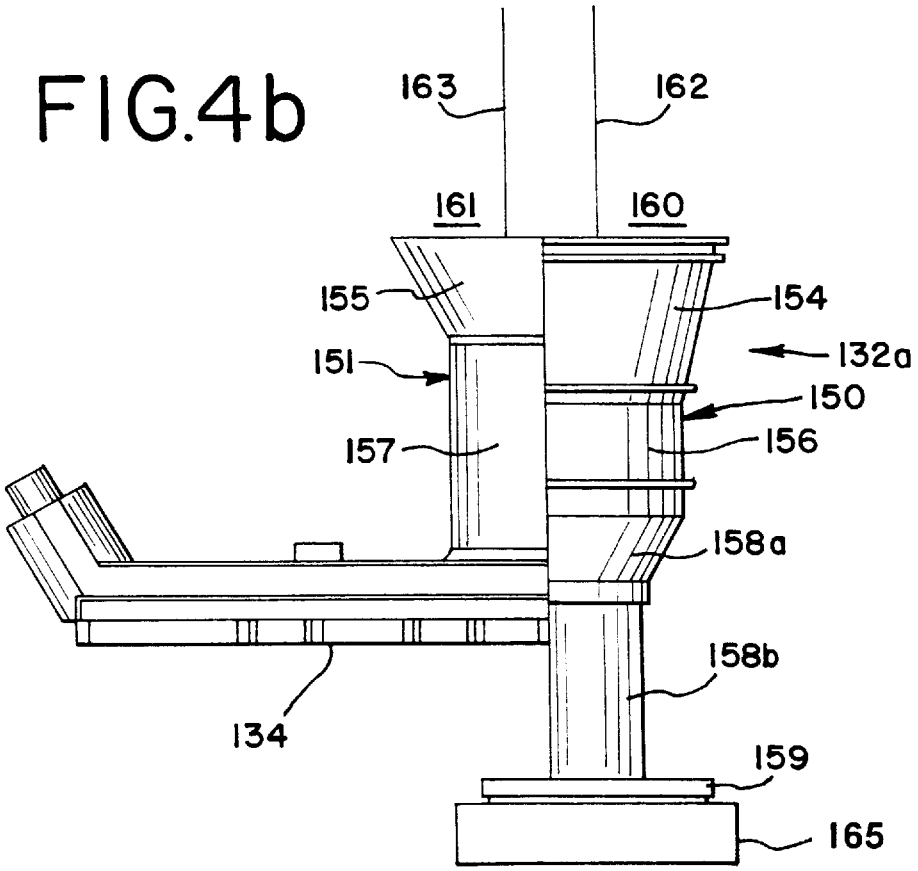
Figure 4C:
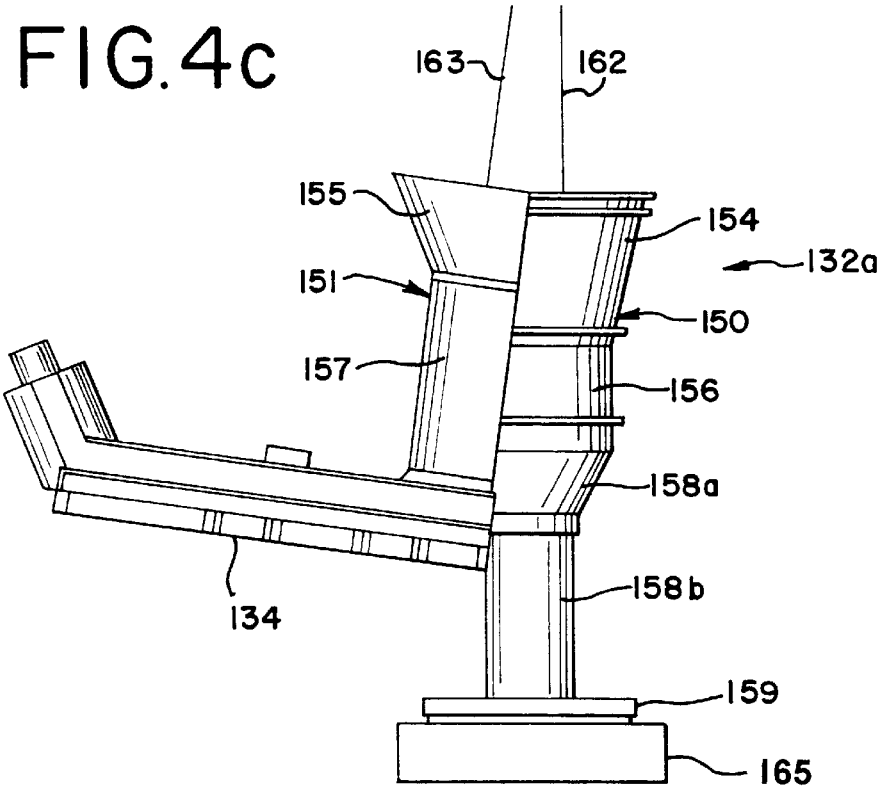

FIGS. 4*a*, 4*b*, and 4*c*, is a more detailed illustration of a siamese feedhorn 132*a* embodying the present invention. The siamese feedhorn 132*a* incorporates a first generally circular waveguide section 150 mated with a second generally circular waveguide section 151. The first waveguide section 150 receives linearly polarized signals, and the second waveguide section 151 receives circularly polarized signals. Preferably, the first waveguide section 150 is fitted with a linear polarizer 165. Alternatively, waveguide ports or openings positioned at 90° apart may be provided for receiving linearly polarized signals. A second waveguide section 151 has a circular cross-section for receiving circularly polarized signals.

The dimensions of the waveguide sections 150, 151 are selected to according to the proper diameter to receive signals over the desired frequency range without reaching the waveguide cut-off frequency. Waveguides typically have upper and lower cut-off frequencies that are determined by their physical dimensions. Feedhorns receiving lower frequency signals typically have larger physical dimensions, and feedhorns receiving higher frequency signals typically have smaller physical dimensions. A waveguide's dimensions are selected so the waveguide can receive signals over the desired frequency range without reaching its cut-off frequency. Preferably, the dimensions of the first waveguide section 150 are chosen to receive signals at the lower Ku-band frequencies, below 12 GHz. The dimensions of the second waveguide section 151 are preferably chosen to receive signals in the upper Ku2-band frequencies, above 12 GHz. Each waveguide section 150, 151 also has a horn 154, 155 (FIG. 4*b*) to properly illuminate the antenna aperture. If desired, the first waveguide section 150 may include a portion of rectangular cross-section.

In a particular embodiment, first waveguide section 150 is comprised of the DIRECPCW feedhorn and LNB available from Hughes Network Systems. The second waveguide section 151 is comprised of the feedhorn and LNB available with the RCA DSS® receiver. In this embodiment, the waveguide sections are made of ordinary die-cast metal. The two waveguide sections 150, 151 are positioned so that the central axes or boresights 162, 163 of the two sections 150, 151 are separated by the fixed 1.5 to 2.5 cm distance between the focal point 140 and the offset location 141.

To create the disclosed siamese feed horn construction, the DIRECPC™ and DSS® feedhorns are sliced along their length, preferably removing ⅓ of each feedhorn. The remaining ⅔ portions of the DIRECPC™ and DSS feedhorns are joined the first waveguide section 150, and the ⅔ portion of the DSS® feedhorn forms the second waveguide section 151.

The two sliced waveguide sections 150, 151 are axially mated to form the siamese feedhorn 132*a*. The two waveguide sections 150, 151 are preferably aligned and matched as shown in FIGS. 4*a* and 4*b*. The waveguide sections are positioned side-by-side and can be welded, epoxyed, clamped or secured together in any other desired manner. The apertures 160, 161 of horns 154, 155 are aligned as illustrated in FIG. 4*a* to form a siamese "double-barrel." Alternatively, the boresights 162, 163 of the two waveguide sections 150, 151 may be angled so the waveguide apertures point toward each other as shown in FIG. 4*c*. The two waveguide sections can be angled up to 45°. Preferably, they are angled at 10° to 20°. The boresights 162, 163 of the two sections may also be parallel, as shown in FIG. 4*b*.

Both waveguide sections 150, 151 preferably have decreasing diameter circular horns 154, 155 (FIG. 4*b*) to properly illuminate a 24-inch antenna, such as the antenna 131. Both circular horns 154, 155 meet circular sections 156, 157 having a constant radius. Using the DIRECPC™ feedhorn, first waveguide section 150 has a second decreasing radius section 158*a* which meets a second circular section 158*b* of a constant radius. First waveguide section 150 ends in a flange 159 which is coupled to a circular to linear waveguide coupler or linear polarizer 165 to allow attachment to a linear LNB 133 (FIG. 2).

A small probe (not shown) within each of the waveguide sections 150, 151 is the element that actually responds to received signals by generating a weak electrical current. First waveguide section 150 selects between horizontal and vertical linear polarizations using one of several techniques to physically re-orient the probe. For example, the waveguide coupler 165 can be physically rotated. The small antenna probe can be physically rotated by a mechanical drive assembly, such as a servo motor, which turns the probe to select between linear polarizations.

Polarization may also be selected by providing a ferrite device capable of switching polarity. Ferrite devices have the general advantage of having no moving parts. Ferrite devices switch polarity via the interaction between the incoming signal with a magnetic field in a manner well known in the art. An electric coil supplies a magnetic field whose orientation changes depending on the polarity of the detected signal.

Another method of selecting polarity involves using a PIN diode to provide electronic switching between two probes mounted in the feed. One drawback of using PIN switching with linear polarization, however, is the inability to provide fine tuning to compensate for skew adjustments. To allow the best possible reception, a feedhorn receiving linearly polarized signals must be correctly aligned (skewed) with the plane of the polarized signal. With PIN diode switching, the two probes are ordinarily in a fixed orientation and thus no fine tuning is provided.

Preferably, second waveguide section 151 receives circularly polarized signals. Because skew adjustments are not necessary with circularly polarized waves, electronic PIN diode switching between left-hand and right-hand polarized signals is most preferred. PIN diode switching, as is well known in the art, uses two internal probes (not shown) positioned at fixed right angles to detect received signals. The output of one probe is delayed by one-quarter wavelength of the received signal relative to the other probe. The two signals can be added to determine the signal polarity. Electronically reversing the probe delay allows the other signal polarity to be detected.

Preferably, the siamese feedhorn 132 is held by feedhorn support 135 such that the boresight 162 of the first waveguide section 150 is positioned at the focal point 140 of the antenna 131 (FIG. 2). At focal point 140, first waveguide section 150 receives signals from within the antenna beamwidth 138. For example, with the antenna boresight 137 aimed at the 99.0° W longitude position, the first waveguide section 150 receives the linearly polarized, Ku-band transmissions from the Galaxy 4 satellite 104.

The second waveguide section 151 has its boresight 163 positioned at the offset location 141 when the boresight 162 of first waveguide section 150 is positioned at the focal point 140. For example, the second waveguide section receives circularly polarized signals from the 101° W longitude satellites 105*a*, 105*b*.

Like the azimuth angle, the elevation of the offset location 141 also varies according to the separation between the satellite and the terrestrial location of the antenna. To receive the satellites 105*a*, 105*b* at the offset location 141, the boresight 163 of the second waveguide section 151 is preferably matched to the elevation angle 149 (FIG. 4*a*) of the offset location 141.

For example, from the Los Angeles area, the offset location 141 appears at an elevation angle 149 of +0.94° above the focal point. Accordingly, the boresight 163 of the second waveguide section 151 must be positioned with its boresight 163 at +0.94° of elevation. From Washington, D.C., the elevation angle 149 of the offset location 141 is −0.98°. Accordingly, from Washington, D.C., the second waveguide section 151 is positioned with its boresight 163 at −0.98° of elevation to match the offset location 141. Thus, as can be readily seen, the offset in elevation of the boresight 163 from the focal point of the antenna may be between about +1° and −1°. The elevation angles 149 for other locations can be readily calculated by one skilled in the art.

The siamese feedhorn 132 is rotated around the boresight 162 to give the boresight 163 the desired elevation angle 149. At the desired elevation angle 149, the boresight 163 of the second waveguide section 151 is matched to the offset location 141. The siamese feedhorn 132 is preferably fitted with an adjustment mechanism such as a collar or clamp 148 (FIG. 2) which allows it to rotate about boresight 162.

Each waveguide section 150, 151 preferably has its own low noise block (LNB) 133, 134. An LNB is preferably comprised of an integrated low noise amplifier and a low noise converter. In the preferred embodiment, the first LNB 133 is a linear LNB such as used by the DIRECPCW receiver sold by Hughes Network Systems. The second LNB 134 for receiving circularly polarized signals is preferably the DSS® LNB, sold under the RCA and Sony brand names.

The LNBs 133, 134 detect signals relayed from the feedhorn 132, convert the signals to an electrical current, amplify the signals, and downconvert the signals to a lower frequency. LNBs typically downconvert signals from the received frequencies to frequencies between 900 MHz and 2000 MHz. In the preferred embodiment, the LNB downconverts signals to the 950 to 1450 MHz range. The downconverted signals are then amplified and relayed along a coaxial cable to an indoor receiver.

Figure 5:
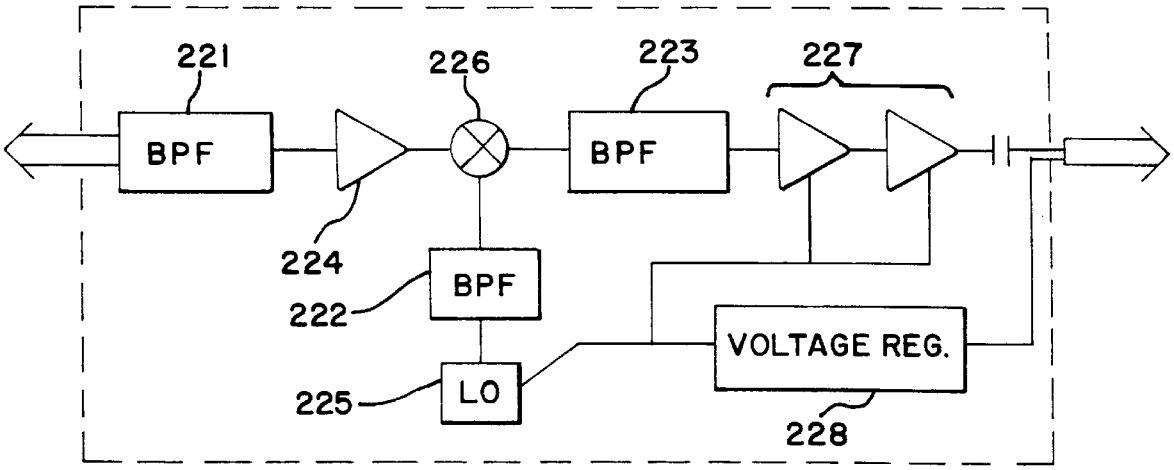
FIG. 5 is a block diagram of the low noise block (LNB) shown in FIG. 2.

LNBs for both large and small satellite receivers are well known to those skilled in the art. FIG. 5 shows a block diagram of a typical LNB for a satellite receiver. Bandpass filters (BPF) 221, 222, 223 remove unwanted frequency signals while allowing desired signals to pass. Preferably, a field effect transistor (FET) amplifier 224 pre-amplifies the signal before it is mixed to the desired frequency. FET amplifier 224 is preferably a GaAs amplifier that provides a gain of 10 dB with a noise figure of 0.9 dB or less. Preferably, FET amplifier 224 provides a gain of 30 dB to 60 dB.

Local oscillator (LO) 225 and Schottky diode 226 mix the signal to the desired frequency. The signal is then amplified by amplifier stage 227 before being sent out on a shielded coaxial to an indoor receiver. A voltage regulator 228 preferably regulates the voltage provided by LNBs 133, 134 to the indoor receiver.

Figure 6A:
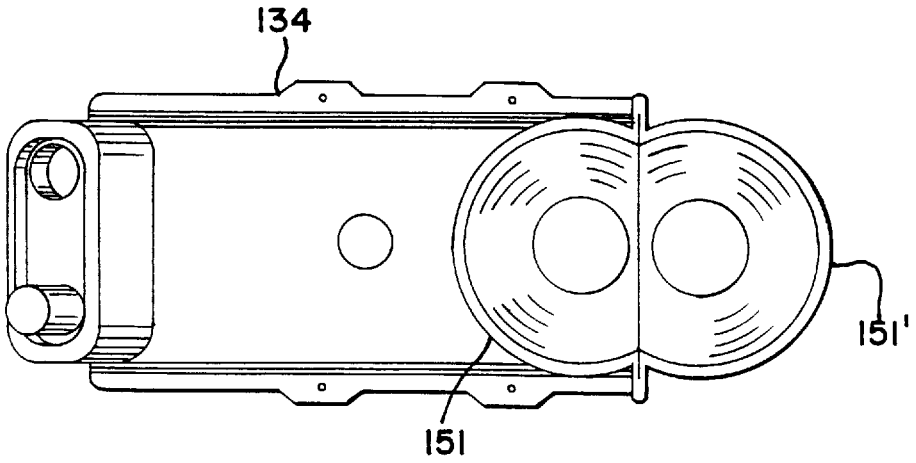
FIGS. 6*a* and 6*b* are axial and side views, respectively, of a another embodiment of the siamese feedhorn of the satellite receiver shown in FIG. 2.
Figure 6B:
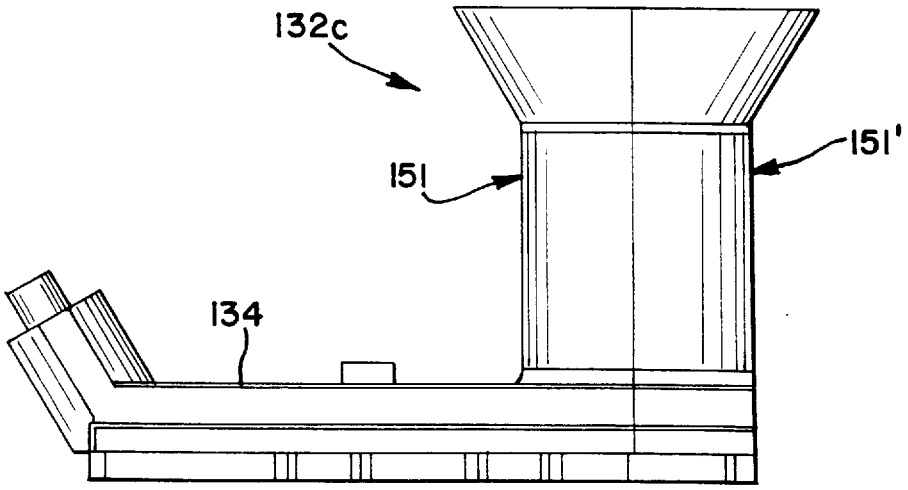

FIGS. 6*a* and 6*b* show another embodiment of a siamese feedhorn 132*c* of the present invention. The siamese feedhorn 132*c* may be utilized with a large aperture antenna (over 1.8 meters) to receive signals from satellites in very close geostationary positions, 1.0° of arc apart or less. Such a situation arises, for example, when attempting to receive satellites 105*a*, 105*b*, at 101.2° W longitude and 100.8° W longitude, from a location such as Honolulu, Hi. Satellites 105*a*, 105*b* downlink to the continental United States in a focused CONUS beam footprint 108 (FIG. 1). To receive the satellite signals in Hi., which is outside the CONUS footprint, a large aperture antenna is required.

A 5.5 meter aperture antenna, however, has a narrow beamwidth of only 0.32°. The 5.5 meter antenna sees only 0.16° (0.32°/2) of arc to either side of the satellite position to which it is boresighted. Satellites 105*a*, 105*b* are at 101.2° W longitude and 100.8° W longitude, 0.4° of arc apart. The 5.5 meter aperture antenna therefore sees only the satellite which it is directly boresighted. The second satellite is outside the beamwidth 138 of the large aperture antenna and is not seen at the antenna focal point.

Like the small aperture antenna, however, the large aperture antenna sees the satellite 105*b* outside of its beamwidth at an offset distance from its focal point. To receive satellites 105*a*, 105*b*, siamese feedhorn 132*c* is preferably constructed of two mirror-image waveguide sections 151, 151' (FIGS. 6*a* and 6*b*). Both waveguide sections 151, 151' are constructed to receive circularly polarized signals. The two waveguide sections may be made from two sections of the DSS® feedhorn sliced and mated as described in connection with the previous embodiment.

Those skilled in the art will recognize that most large aperture antennas are of a Cassegrain or Gregory construction. Both Cassegrain and Gregory antennas use a small subreflector to redirect signals received by the large aperture antenna. An antenna is preferably not operated as a Cassegrain or Gregory antenna when utilizing the siamese feed. When utilizing the siamese feed with the large aperture antenna, the subreflector is removed and the antenna preferably operated as a prime focus antenna.

At present, DBS-2 105*b* is actually two satellites, DBS-2 and DBS-3, operating in tandem as a single high-power, 240 watt satellite. DBS-1, at 120 watts, operates at one-half the power of the DBS-2/3 satellite pair. Accordingly, the large aperture antenna is preferably boresighted at the lower-power DBS-1 satellite and the first waveguide section 151 is positioned at the focal point 140. The second waveguide 151' section is positioned at the offset location 141 to receive signals from the higher-power DBS-2/3 tandem.

In the near future, a fourth DBS satellite, DBS-4, will launch in a collocated orbit with DBS-1. Like DBS-2 and DBS-3, DBS-1 and DBS-4 can be operated in tandem as a single 240 watt satellite. The satellite signals received by both waveguides sections 151, 151' would thus be of equal power. When two satellites signals of equal power are to be received, the antenna of the present invention is preferably boresighted directly between the two satellites. The two satellite signals are received at two offset locations on either side of the focal point. Accordingly, the boresight of each of the waveguide sections is positioned at the two offset locations. The two offset locations are about 0.75 to 1.25 cm on either side of the antenna focal point. The required elevation angles can be readily calculated by one skilled in the art. This embodiment of the invention can also be used with even larger aperture antennas, such as a 7.3 meter aperture antenna, for example.

The siamese feedhorn of the present invention allows a fixed antenna to simultaneously receive multiple broadcasts from satellites in different geostationary positions without requiring a specially designed reflector or the antenna to be re-aimed. The reception of satellite signals from different satellites in close geostationary positions is thus achieved without a separate antenna for each satellite. The siamese feed can also be used to receive signals from satellite in widely spaced geostationary positions. For example, with an 18 inch aperture antenna the siamese feed can receive signals from satellites approximately 4° of arc apart.

Figure 7A:
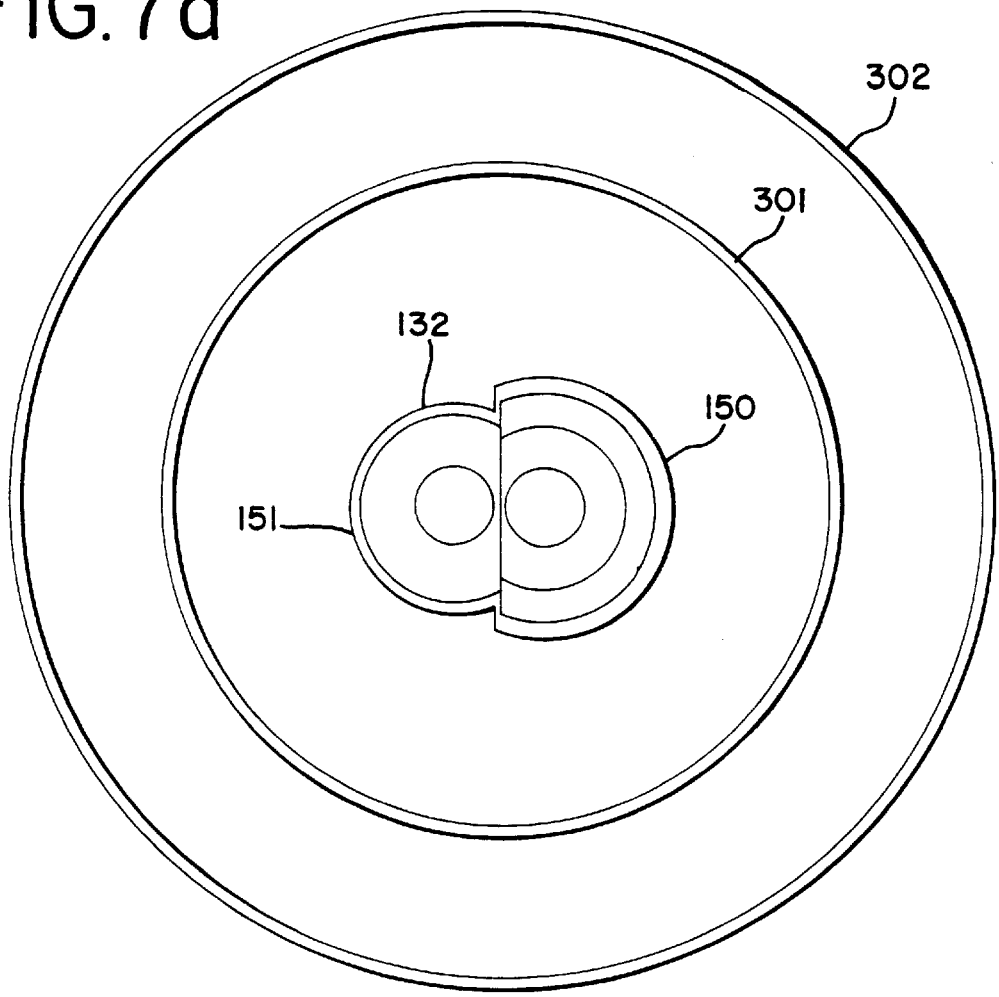
FIGS. 7*a* and 7*b* yet another embodiment of the siamese feedhorn of the present invention.
Figure 7B:
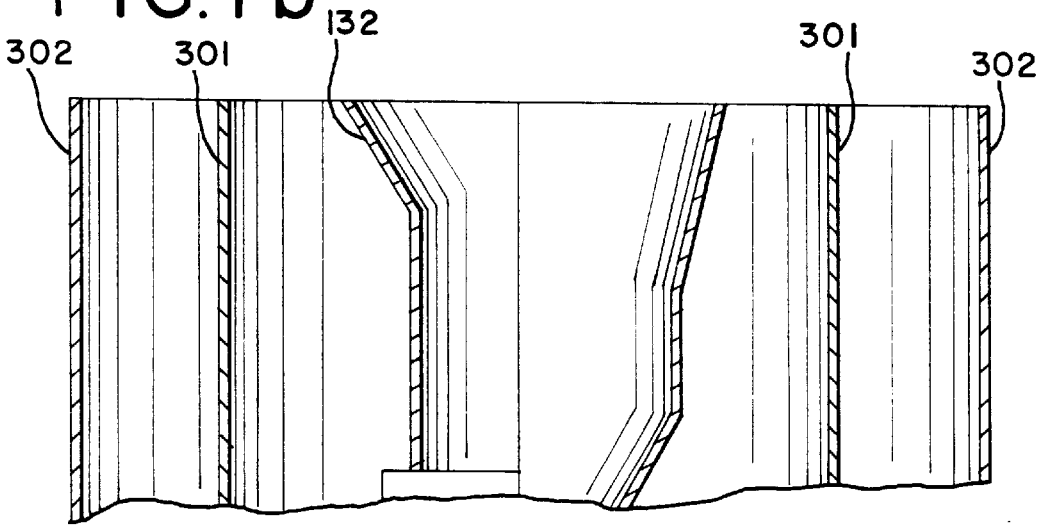

Yet another embodiment of the invention, shown in FIGS. 7*a* and 7*b*, allows a single antenna to receive different frequency signals from one geostationary position while simultaneously receiving signals from a satellite in a different geostationary position. As shown in FIGS. 7*a*, 7*b*, a siamese feedhorn 132 is combined with a pair of coaxial feedhorns 301, 302. The coaxial feedhorns may comprise a large C-band feedhorn 301 concentrically located within a larger L-band feedhorn 302. The dimensions of the C-band 301 and L-band 302 feedhorns are selected according to the diameter needed to receive signals over the desired frequency range without reaching the waveguide cut-off frequency. The siamese feedhorn 132 is positioned within the large C-band feedhorn 301. The larger L-band feedhorn 302 is concentrically positioned over the C-band feedhorn 301.

An antenna utilizing the combination feedhorns 301, 302 is preferably boresighted at the collocated satellites broadcasting at the C-band, L-band and Ku-band frequencies. The concentric feedhorns 301, 302 and the first waveguide section 150 of the siamese feedhorn 132 are positioned with their boresights at the antenna's focal point to receive the C-band, L-band and Ku-band signals. The second waveguide section 151 of the siamese feedhorn 132 allows simultaneous reception of signals from a satellite in a different geostationary position, as described above.

Of course, it should be understood that a wide range of changes and modifications can be made to the embodiments described herein without departing from the scope of the invention. For example, more than two waveguide sections may be combined to receive signals at several locations offset from the focal point of the antenna. Thus, the disclosed siamese feedhorn may be combined with a third waveguide section to form a triple-head feedhorn. In addition, two siamese feedhorns may be combined to form a quad-head feedhorn.

It is therefore intended that it is the following claims, including all equivalents, which are intended to define the scope of the invention.

We claim:

1. A feedhorn for use with a satellite antenna adapted to receive signals from different locations, comprising:

a single piece horn mechanism having two waveguides integrally connected along a side thereof;

an opening in the side between the waveguides:

a first boresight; and a second boresight, said second boresight at an offset distance from said first boresight.

2. The device of claim 1 wherein said second boresight is at an offset distance between approximately 1.5 cm to approximately 2.5 cm from said first boresight.

3. The device of claim 1 wherein said first boresight and said second boresight form an angle between approximately 0° to approximately 45°.

4. The device of claim 1, wherein said first boresight and said second boresight form an angle between approximately 10° to 20°.

5. The device of claim 4 wherein said first boresight and said second boresight form an angle of approximately 15°.

6. The device of claim 1 wherein said first boresight is parallel with said second boresight.

7. A feedhorn for use with a satellite antenna adapted to receive signals from different directions, comprising:

a first waveguide section;

a second waveguide section, said second waveguide section placed side-by-side and meeting with said first waveguide section along a portion of the length thereof; and an opening between the first waveguide section and the second waveguide section at the portion where the first and second waveguide sections meet.

8. The device of claim 7 wherein said first and said second waveguide sections each have a boresight, said boresight of said first waveguide section is offset a distance from said boresight of said second waveguide section.

9. The device of claim 7 wherein said first and said second waveguide sections each have a boresight, said boresight of said first waveguide section is offset a distance between approximately 1.5 cm to 2.5 cm from said boresight of said second waveguide section.

10. The device of claim 7 wherein said first and said second waveguide sections each have a boresight, said boresight of said first waveguide section and said boresight of said second waveguide section form an angle between approximately 0° and approximately 45°.

11. The device of claim 7 wherein said first and said second waveguide sections each have a boresight, said boresight of said first waveguide section and said boresight of said second waveguide section form an angle between approximately 10° to approximately 20°.

12. The device of claim 7 wherein said first and said second waveguide sections each have a boresight, said boresight of said first waveguide section and said boresight of said second waveguide section form an angle of approximately 15°.

13. The device of claim 7 wherein said first and said second waveguide sections each have a boresight, said boresight of said first waveguide section is parallel with said boresight of said second waveguide section.

14. The device of claim 7 wherein said first waveguide section is a circular waveguide.

15. The device of claim 14 wherein said first waveguide section is fitted with a linear polarizer.

16. The device of claim 7 wherein said first waveguide section has a portion of rectangular cross-section.

17. The device of claim 7 wherein said second waveguide section is circular waveguide.

18. The device of claim 7 wherein said first waveguide section and said second waveguide section are integrally constructed.

19. The device of claim 7 wherein said first waveguide is constructed to receive a linearly polarized signal at the Ku-band frequencies.

20. The device of claim 7 wherein said second waveguide is constructed to receive a circularly polarized signal at the Ku2-band frequencies.

21. The device of claim 7 wherein said first waveguide is constructed to receive a circularly polarized signal at the Ku2-band frequencies.

22. The device of claim 7 wherein said first waveguide receives a signal transmitted at a lower power than a signal received by said second waveguide section.

23. A satellite receive antenna comprising:

an antenna having a focal point and an offset location;

a feedhorn, comprising, a first waveguide section having a boresight at said focal point of said antenna;

a second waveguide section, said second waveguide section having a boresight at said offset location and meeting with said first waveguide section along a portion of the length thereof; and an opening between the first and second waveguide sections at a point where the first and second waveguide sections meet.

24. The device of claim 23 wherein the second waveguide section boresight is positioned at said offset location approximately 1.5 cm to 2.5 cm from said focal point.

25. The device of claim 23 wherein said second waveguide boresight is offset in elevation from said focal point between about +1° and −1°.

26. The device of claim 23 wherein said antenna is a parabolic offset antenna.

27. The device of claim 23 wherein said antenna has an aperture size of less than 36 inches.

28. The device of claim 23 wherein said antenna has an aperture size of 24 inches.

29. The device of claim 23 wherein said antenna is a prime focus antenna.

30. The device of claim 23 wherein said antenna is a 5.5 meter aperture prime focus antenna.

31. The device of claim 23 wherein said antenna is a flat antenna.

32. The device of claim 31 wherein said flat antenna is a Fresnel lens type antenna.

33. The device of claim 23 wherein said antenna is boresighted at a satellite such that said first waveguide section receives a linearly polarized satellite signal and said second waveguide receives a circularly polarized satellite signal.

34. The device of claim 23 wherein said first waveguide section and said second waveguide section both receive circularly polarized signals.

35. The device of claim 23 wherein said first waveguide section and said second waveguide section both receive linearly polarized signals.

36. The device of claim 23 wherein said first waveguide section and said second waveguide section receives a signal from any block of frequencies from about 10 GHz to about 13 GHz.

37. The device of claim 23 wherein said first waveguide section receives a signal from about 3 GHz to about 5 GHz in frequency.

38. The device of claim 23 wherein said first waveguide section receives a signal from about 950 MHz to about 2 GHz in frequency.

39. The device of claim 23 wherein said first waveguide section receives a signal from about 10 GHz to about 12 GHz in frequency and said second waveguide section receives a signal from about 12 GHz to about 13 GHz in frequency.

40. The device of claim 23 wherein said antenna is an antenna having an aperture of 5.5 meters.

41. The device of claim 23 wherein said antenna is an antenna having an aperture of 7.3 meters.

42. The device of claim 23 wherein said first waveguide section and said second waveguide sections receive circularly polarized signals from geostationary satellites at 100.8° W longitude and 101.2° W longitude, respectively.

43. The device of claim 23 wherein said first and said second waveguide sections receive signals from approximately 10 GHz to approximately 13 GHz.

44. A method of receiving two signals from two satellites in different geostationary positions comprising the steps of:

placing a feedhorn having two integrally connected waveguides in proximity to an antenna having a focal point so that an opening exists between interior sides of the integrally connected waveguides;

receiving a first satellite signal from said first geostationary satellite at the focal point; and receiving a second satellite signal from a second geostationary satellite at an offset location from said focal point.

45. The method of claim 44 wherein said offset location is about 1.5 to about 2.5 cm from said focal point.

46. The method of claim 44 wherein said first satellite signal is transmitted at a lower-power than said second satellite signal.

47. The method of claim 44 wherein said first satellite signal is transmitted at about the same power as said second satellite signal.

48. The method of claim 44 wherein said offset location is offset in elevation from said focal point between about +1° and −1°.

49. The method of claim 44 wherein said first satellite signal is a linearly polarized signal and said second satellite signal is a circularly polarized signal.

50. The method of claim 44 wherein said first satellite signal and said second satellite signal are circularly polarized signals.

51. The method of claim 44 wherein said first satellite signal and said second satellite signal are linearly polarized signals.

52. A satellite receive antenna comprising:

an antenna having a focal point, a first offset location and a second offset location;

a feedhorn comprising, a first waveguide section having a boresight;

a second waveguide section having a boresight, said second waveguide section meeting with said first section along a portion of the length thereof; and an opening between the first and second waveguide sections at a point where the first and second waveguide sections meet:

wherein said first waveguide section has a boresight positioned at a first offset location; and said second waveguide section is positioned at a second offset location.

53. The device of claim 52 wherein said first and said second offset locations are both between 0.75 cm and 1.25 cm away from said focal point of said antenna.

54. The device of claim 52 wherein said first and said second waveguide sections each receive signals transmitted at approximately equal power.

55. The device of claim 52 wherein said first waveguide section and said second waveguide section both receive circularly polarized signals.

56. The device of claim 55 wherein said first waveguide section and said second waveguide sections receive circularly polarized signals from geostationary satellites at 100.8° W longitude and 101.2° W longitude, respectively.

57. A method of receiving signals from two satellites in different geostationary positions comprising the steps of:

placing a feedhorn having two integrally connected waveguides having an opening between interior portions thereof in proximity to an antenna having a focal point and first and second offset locations;

receiving a first satellite signal from a first geostationary satellite at the first offset location of said antenna; and receiving a second satellite signal from a second geostationary satellite at the second offset location of said antenna.

58. The method of claim 57 wherein said first offset location and said second offset location are both about 0.75 cm to about 1.25 cm from said focal point.

59. The method of claim 57 wherein said first offset location and said second offset location receive signals transmitted at about the same power.

60. The method of claim 57 wherein said first waveguide section and said second waveguide section both receive circularly polarized signals.

61. The method of claim 57 wherein said first waveguide section and said second waveguide sections receive circularly polarized signals from geostationary satellites at 100.8° W longitude and 101.2° W longitude, respectively.

62. A feedhorn for use in a satellite receive antenna, comprising:

a first waveguide section having a circular construction;

a second waveguide section having a circular construction, said second waveguide section placed side-by-side and mated with said first waveguide section; and a third circular waveguide section, said first and second waveguide sections disposed within said third waveguide section;

wherein each of said first, second, and third waveguide sections is adapted to receive a different signal for demodulation.

63. The device of claim 62 wherein said first waveguide section is concentrically positioned within said third circular waveguide.

64. The device of claim 62 wherein said third circular waveguide receives a signal about 3 GHz to about 5 GHz in frequency.

65. The device of claim 62 wherein said third circular waveguide receives a signal about 950 MHz to about 2 GHz in frequency.

66. The device of claim 62 wherein said first waveguide section receives a lower power signal than said second waveguide section.

67. The device of claim 62 further comprising:

a fourth circular waveguide section, said fourth circular waveguide section having greater diameter than said third waveguide section;

wherein said third circular waveguide is concentrically positioned within fourth circular waveguide section.

68. The device of claim 67 wherein said fourth waveguide section receives a signal about 950 MHz to about 2 GHz in frequency.

* * * * *